United States Patent [19]

Ross

[11] 4,253,574

[45] Mar. 3, 1981

[54] APPARATUS AND METHOD FOR SORTING PICKLES

[75] Inventor: Edward E. Ross, San Rafael, Calif.

[73] Assignee: Del Monte Corporation, San Francisco, Calif.

[21] Appl. No.: 963,281

[22] Filed: Nov. 24, 1978

[51] Int. Cl.[3] ..... B07C 5/12

[52] U.S. Cl. ..... 209/668; 209/673; 209/940; 209/920

[58] Field of Search ..... 209/940, 668, 673, 920, 209/921, 664, 669, 671, 672, 707, 676

[56] References Cited

U.S. PATENT DOCUMENTS

| | | | |
|---|---|---|---|
| 1,109,866 | 9/1914 | Nunamaker | 209/676 |
| 3,367,494 | 2/1968 | Peterson | 209/668 |
| 3,592,249 | 6/1971 | Ross . | |
| 3,682,291 | 8/1972 | Lent . | |
| 3,702,655 | 11/1972 | Cox | 209/544 |
| 3,756,368 | 9/1973 | Lent . | |
| 4,148,398 | 4/1979 | Mustikka | 209/668 |

FOREIGN PATENT DOCUMENTS

| | | | |
|---|---|---|---|
| 7507606 | 2/1976 | Netherlands | 209/673 |

*Primary Examiner*—Allen N. Knowles
*Attorney, Agent, or Firm*—Flehr, Hohbach, Test, Albritton & Herbert

[57] ABSTRACT

Apparatus for separating pickles of an undesired configuration (e.g., crooked or enlarged at one end) from those of acceptable configuration (e.g., relatively straight and uniform from end to end). It employs a series of horizontally spaced rods to which the pickles are fed and over which the desired pickles are traversed, while undesired pickles (nubbins) fall through the spaces between the rods. The means that supports and journals the rods is such that the spacing between the rods can be adjusted while maintaining equal spacing between adjacent rods for the entire series.

2 Claims, 11 Drawing Figures

APPARATUS AND METHOD FOR SORTING PICKLES

BACKGROUND OF THE INVENTION

This invention relates generally to apparatus and methods for segregating pickles of a desired configuration from those having an undesired configuration.

In the manufacture of pickles, and particularly pickles which may have a length ranging from about 1½ to 6 inches, it is common practice to grade the cucumbers as to diameter before pickling. In general, the diameter and length of cucumbers are directly proportional. After pickling and before packing in glass jars or other containers, they are conveyed past an inspection station where pickles of undesired configuration are detected and manually removed. The undesirable pickles may for example be crooked rather than relatively straight, or may have one enlarged end, although the overall length of the axis may be generally the same as those that are relatively straight and uniform. The latter are desirable for packing in jars with each pickle extending substantially parallel to the jar axis. Pickles that have an undesirable configuration may be separately packed and sold as nubbins. The undesirable configurations may be inherent in the original cucumbers or may be the result of physically imposed distortions occurring during processing which become permanent. Although machines using spaced rollers are known for orienting various agricultural products (see Lent U.S. Pat. No. 3,682,291), insofar as applicant is aware, no commercial machine is available for separating undesirable pickles from the ones desired for packing as described above.

OBJECTS OF THE INVENTION AND SUMMARY

In general, it is an object of the present invention to provide an apparatus and method which separates pickles of undesirable configuration as previously described from those that are relatively straight and uniform from end to end, thus making it possible to dispense with performing this function manually.

Another object of the invention is to provide apparatus which performs the separating function referred to above the mechanism that is relatively simple and inexpensive.

Another object is to provide such apparatus with novel means for effecting an adjustment to enable operation upon pickles of different sizes.

In general, the present invention serves automatically to separate pickles of an undesirable configuration (e.g., crooked or enlarged at one end) from those of acceptable configuration (e.g., relatively straight and uniform from one end to the other). The apparatus comprises means for conveying the pickles in the direction of their length, together with a series of parallel and generally horizontal rods having their axes extending laterally of the direction of movement of the conveyed pickles. The spacing between the axes of the rods is adjusted whereby it is substantially less than the general length of the pickles being sorted. The rods are driven in one direction of rotation, and the conveying means is disposed to deliver the pickles to the first one of the series of rods. The direction of rotation is such that the pickles of desired configuration are advanced endwise from the conveyer to the upper surface of the first rod, and by contact with the first rod they are continuously conveyed endwise over the rods of the series and across the spaces between the same. The pickles which traverse all of the rods of the series are received by suitable means such as a conveyer and moved to the packing station. The spacing between the rods and the action of the rods upon the pickels is such that undesired pickles, including those that are seriously crooked and those having one end portion that is substantially larger than the other end, drop through the spaces between the rods and are separately removed. Preferably, common means is provided for adjusting the spacing between the rods, and this means is such that the spacing between any two adjacent rods remains equal for different adjustments.

Additional objects and features of the invention will appear from the following description in which the preferred embodiments have been set forth in detail in conjunction with the accompanying drawing.

DESCRIPTION OF THE PREFERRED EMBODIMENTS

Figure 1:
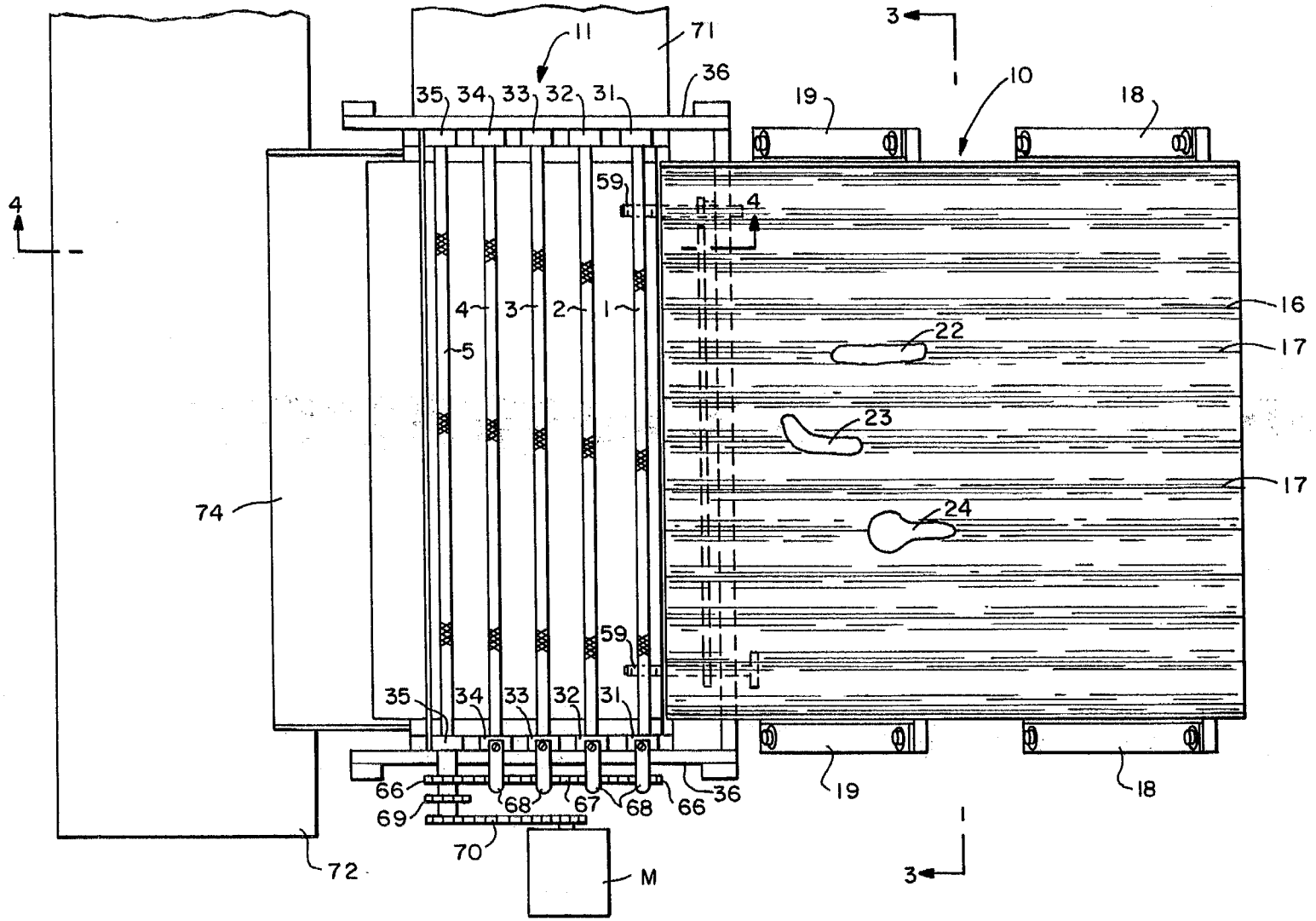
FIG. 1 is a plan view illustrating apparatus incorporating the present invention.
Figure 3:
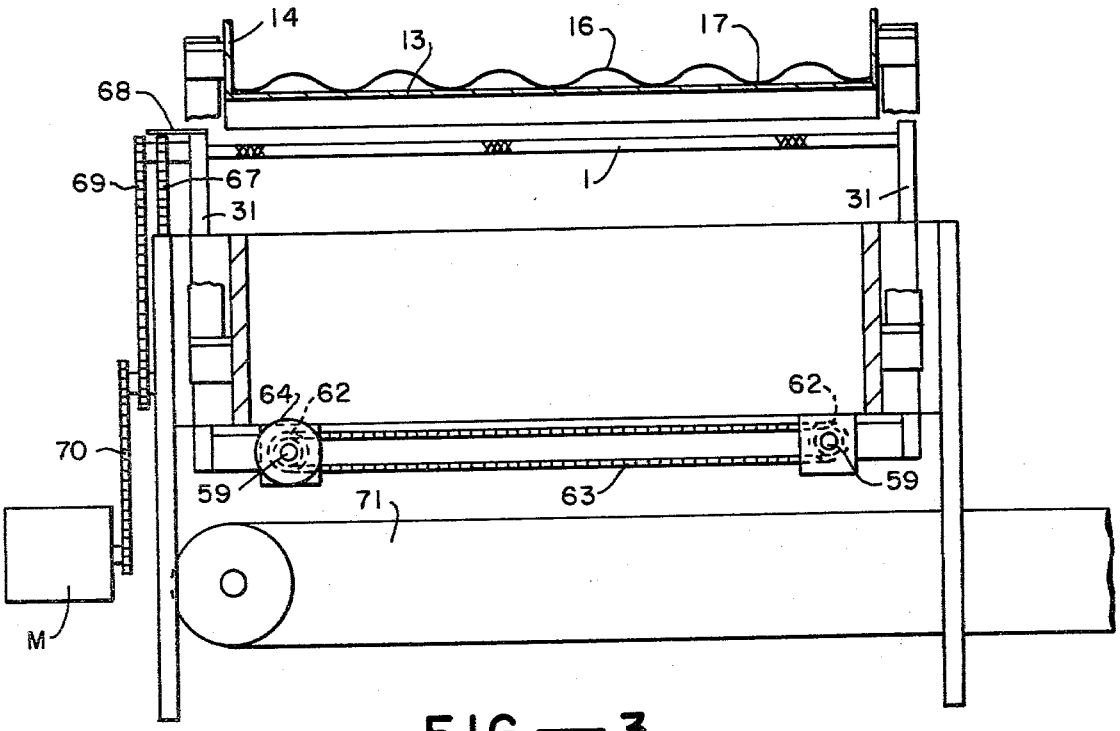
FIG. 3 is a cross-sectional view taken along the line 3—3 of FIG. 1.

The embodiment of the apparatus illustrated in the drawings consists of conveying means 10 which in this instance is of the shaker type. The conveying means serves to deliver pickles to the sorting section 11 where the pickles of undesirable configuration are separated from the desired pickles that are uniform in size and relatively straight. Both the means 10 and 11 are shown carried by the common frame 12. The shaker conveyer is constructed in such a manner that it delivers the pickles in single files to the section 11. It consists in this instance of a bottom wall 13 which may be made of metal and which is provided with the upwardly extending side walls 14. Disposed upon the bottom wall 13 there is a wall 16 which is made of suitable material, such as a fiberglass reinforced synthetic resin, and which is corrugated as illustrated in FIG. 3, thus providing a plurality of parallel troughs 17. The structure just described is carried by the flexible spring members 18 and 19 which in turn are secured to the sides of the main frame 12. Suitable means is employed (not shown) for delivering pickles at a relatively uniform rate to the upper side of the conveyer. A suitable actuator 21, such as one of the electrical or mechanical excentric type, having a stroke that may be adjusted from ⅛ to 1 inch, serves to apply shaking movement to the conveyer, the movement being such that pickles delivered upon the corrugated upper wall 16 are caused to move into the troughs 17 and establish single-file rows of the pickles advancing toward the discharge end of the conveyer. A few pickles are shown in FIG. 1. The uniform pickles desired for packing are indicated at 22. Undesirable configurations (nubbins) are indicated at 23 and 24. The pickle 23 is crooked rather than generally linear, and the pickle 24 has one end portion substantially enlarged compared to the other end portion.

Figure 4:
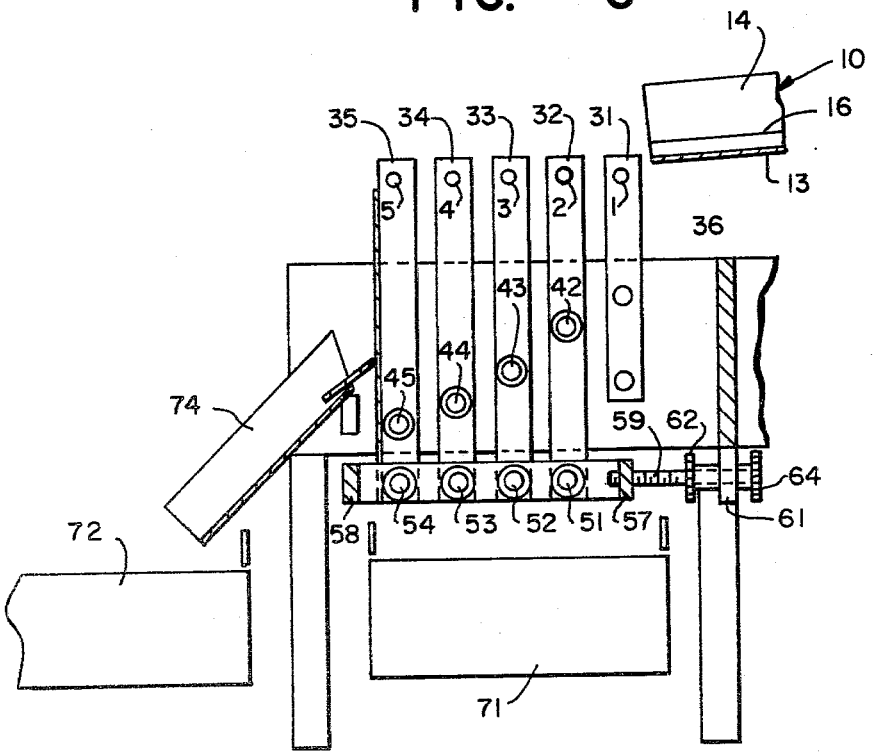
FIG. 4 is a cross-sectional view taken along the line 4—4 of FIG. 1.
Figure 5:
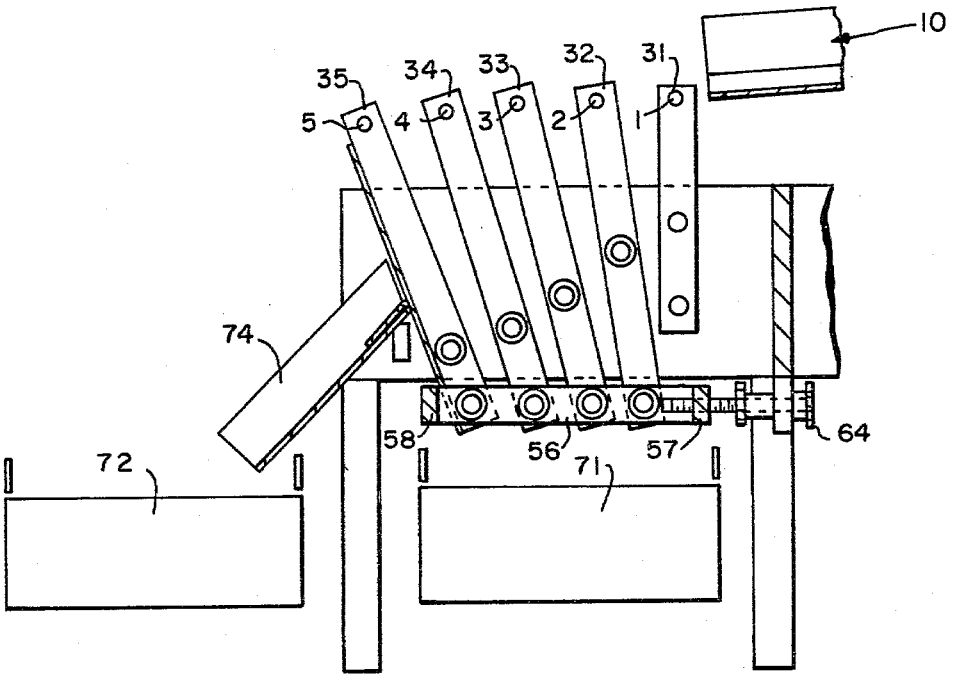
FIG. 5 is a cross-sectional view like FIG. 4, but showing the rods in a different adjusted position.

The sorting section 11 consists of a plurality of rods numbered 1–5 inclusive. These rods are horizontal and extend at right angles to the direction of movement of the pickles on the conveyer 10. The surfaces of the rods are roughened as by rough machine knurling. Their diameter should be a small fraction (e.g., ¼ or less) of the spacing between the rods. In practice the rods have been ¼ inch in diameter for a minimum rod spacing of one inch or more. The two ends of each rod are carried and journalled by a pair of arms which are adjustable. As shown in FIG. 4, these arms are designated 31–35 inclusive. The arms 31 are fixed to the side members 36 of the main frame. The arms 32–35 are carried by pivotal connections 42–45 on the side members 36 of the main frame, whereby they can be positioned at different angles to the vertical. The lower ends of each of the arms 32–35 are secured by pivotal connections 51–54 to the adjacent members 56. These members may be in the form of bars having their extremities connected by cross-bars 57 and 58. The positioning of the bars 56 and 57 and thus the positioning of the various pairs of arms can be adjusted by suitable means such as the threaded rods 59 which are carried by and journalled within the wall 61 of the main frame. These rods have threaded engagement with the cross-connecting bar 57. There are two threaded rods 59, as shown in FIG. 3. They are interconnected by mechanical means whereby they rotate in unison in carrying out the desired adjustments. Thus each rod is provided with a sprocket 62, and the two sprockets are engaged by the chain 63 (FIG. 3). One of the threaded rods is provided with an operating knob 64 which can be turned manually, thereby moving the bars 56 and 57 in such a manner as to swing the pairs of arms 32–35 clockwise or counterclockwise.

Figure 2:
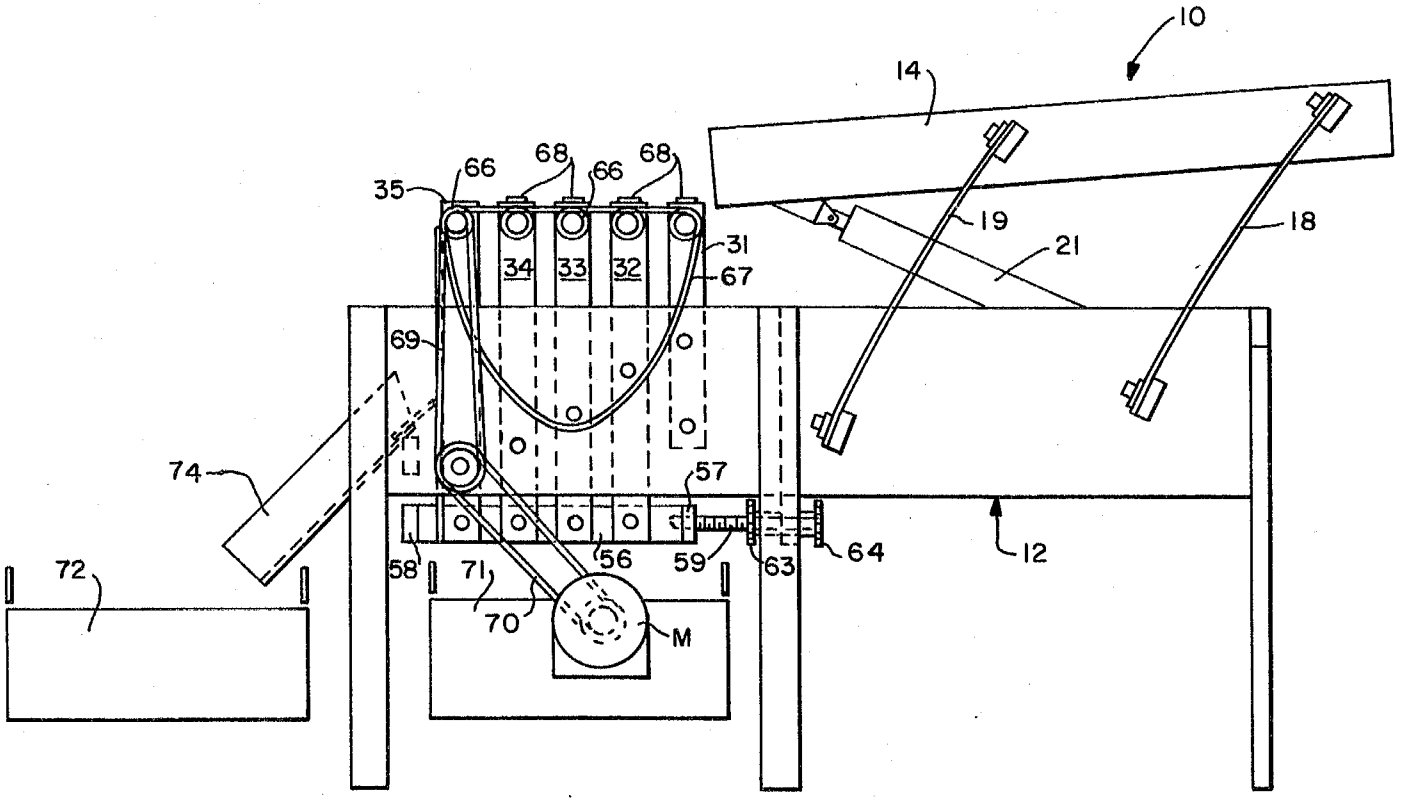
FIG. 2 is a side view of the apparatus shown in FIG. 1.
Figure 6:
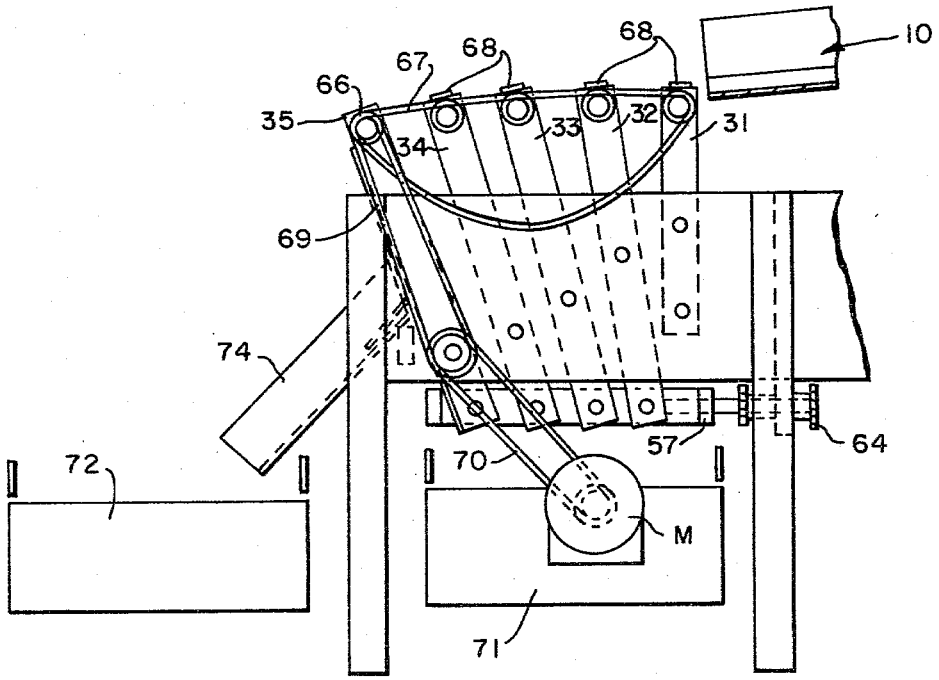
FIG. 6 is a side elevational view looking toward the left side of the apparatus as illustrated in FIG. 3 and showing the rods in the adjusted position of FIG. 5.

Suitable means for driving the rods 1–5 is shown in FIG. 2. One end of each of the rods is provided with a sprocket 66 which is engaged by the upper run of the sprocket chain 67. The chain is retained on each of the sprockets 66 by a finger or tab 68 which is mounted upon the adjacent end of each arm 31–34. For the position of the arms shown in FIG. 1, in which instance they are substantially vertical, the lower run of the chain 67 droops downwardly a substantial distance. However, for an adjusted position such as shown in FIG. 6, the lower run of the chain is shortened.

The rods should be rotated at a speed that will convey the pickles away from the conveyer 10 at a speed that is equal to or preferably faster than the speed at which they are received. Depending upon the rate of delivery of of conveyer 10, a workable speed of rotation may for example be within the range of 100 to 600 rpm. Drive chains 69 and 70 connect the end of rod 5 to the driving motor M.

As will be presently explained, when the apparatus is in operation, pickles of an undesired configuration drop down through the spaces between the rods, whereas pickles of a desired configuration are carried across the rods for discharge. Any one of several suitable means can be provided for collecting and separately removing the two groups. Thus, as shown in FIGS. 3 and 4, an endless belt type of conveyer 71 underlies the series of rods and serves to collect and convey the undesired pickles which fall downwardly through the spaces between the rods. Another conveyer 72 is shown for carrying away the desired pickles. To ensure proper delivery of the desired and undesired pickles to the conveyer, a deflection plate 73 is shown attached to the arms 35, and a chute 74 is shown for diverting the pickles falling from the last roller (5) of the series upon the take-way conveyer 72.

Figure 7:
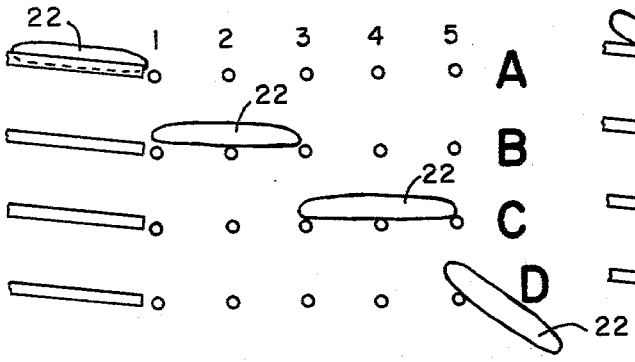
FIGS. 7–11 are schematic views serving to illustrate the manner in which the apparatus and method removes undesired from desired pickles.

Operation of the apparatus and the present method are as follows. FIG. 7 illustrates what happens when a relatively straight and uniform pickle 22 is delivered to the series of rotating rods. The rotation of the rods serves to carry it across the entire series, with the axis of the pickle remaining parallel to the general direction of the conveying movement. A, B, C and D represent the positions of the pickle during a complete traverse over the rods. During this movement the axis of the pickle remains substantially at right angles to the axes of the rods. As previously mentioned, the speed of rotation of the rods preferably is such that the speed of movement of a desirable uniform pickle over the rods is somewhat greater than the speed of movement on conveyer 10. This avoids crowding and interferences in section 11.

As shown in FIG. 7 (e.g., position C) the pickle is slightly longer than the spacing between the rods 2 and 4. However, for the higher speeds of rotation this spacing may be slightly greater than the length of the pickle. since momentum serves to carry the pickle over the spaces without a drop-out.

Figure 8:
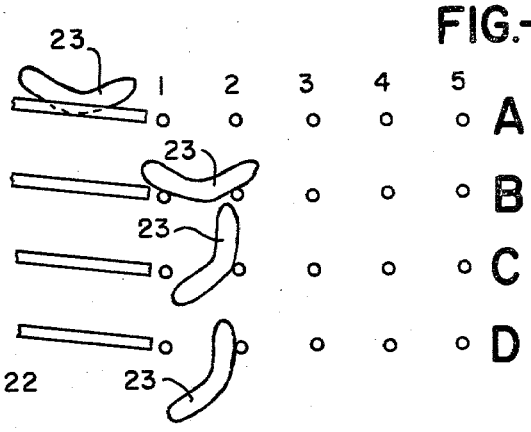

FIG. 8 illustrates what happens when a crooked pickle 23 is received on the rollers. While upon the conveyor 10 the axis of the pickle may be in a plane which is substantially horizontal, or in any event, not vertical. When delivered upon the first roller, it may assume the position B in which there is sufficient traction between roller 2 and the pickle to continue forward tilting movement.

Figure 9:
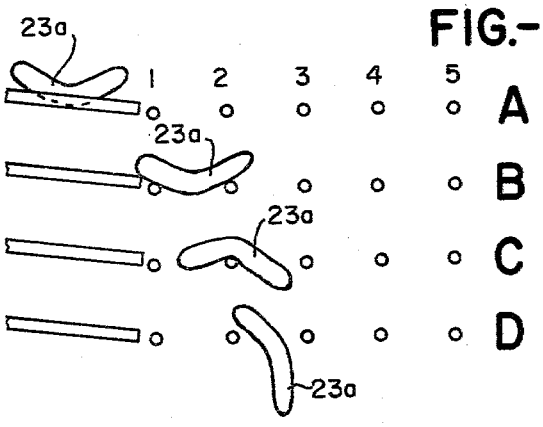
Figure 10:
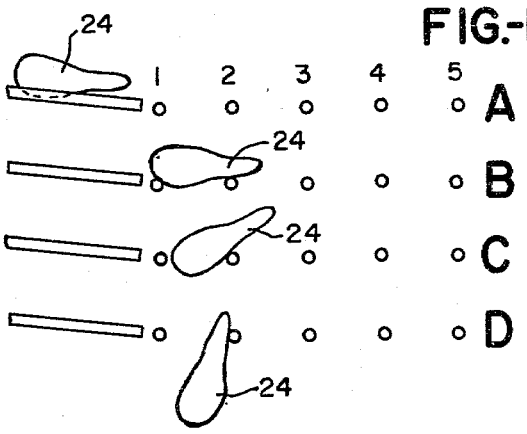
Figure 11:
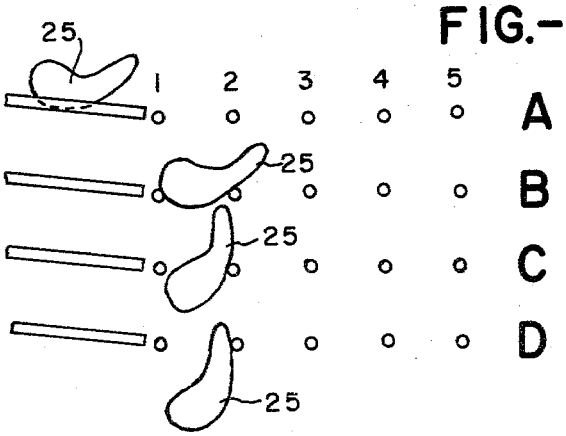

When tilting progresses to position C, the pickle falls as in position D. As illustrated in FIG. 9, the crooked pickle **23*a* may be carried over the second rod, but in doing so it turns through 180° about its axis to fall between the second and third rod. FIG. 10 shows a large nubbin 24. It progresses to position B and then the heavier end portion causes it to fall backward between the first and second rods. FIG. 11** shows a smaller crooked nubbin. It likewise fails to pass over the second rod and falls backward between the first and second rods.

Although in the foregoing it has been assumed that the sorting out action occurs between the rods 1 and 2 or 2 and 3, it will be evident that in some instances the pickles must traverse more than three rods before the sorting out action occurs.

In practice, the spacing between adjacent rods and the speed of rotation is such as will obtain the desired optimum sorting out action. When it is desired to carry out sorting of pickles of a different length, the spacing between the rods must be readjusted. This is carried out by turning the knob 64 whereby the angularity of the arms 32–35 is changed until the rods have the desired spacing. Due to the difference in the positioning of pivot points 42–45 of the arms 32–35, for a given amount of turning movement of the knob 64, the arms 32–35 are swung over increasing angles. The net result is that for any adjustment, the rods have equal spacing and thus the same sorting action occurs as pickles traverse the entire series of rods. A feature of this adjusting means is that it can be carried out while the machine is in operation, thus facilitating fine adjusting or tuning for optimum operation.

Although the invention was conceived and reduced to practice for the machine sorting of pickles, it is considered to be applicable for the sorting of other agricultural products which are generally round in cross section, such as cucumbers before pickling or such as are marketed without processing, and zucchini. Also it can be used to sort according to length, where the product does not include items of undesirable configuration comparable to nubbins. An example is husked ears of corn where the apparatus can be used to remove broken ear pieces or ears that are less than a specified length.

What is claimed is:

1. Apparatus for sorting pickles that are sized as to length to separate pickles having an undesired configuration from those of a desired configuration, comprising means for conveying the pickles in the direction of their length, a series of spaced parallel horizontal rods having their axes extending laterally of the direction of movement of the conveyed pickles, the spacing between two adjacent rods being less than the length of the pickles of desired size and substantially greater than their diameter, means for driving the rods in one direction of rotation, the conveying means being disposed to deliver the pickles to the first one of the series of rods, the direction of rotation of the rods and the spacing between the same being such that pickles of desired configuration are advanced endwise from the conveyer to the upper surface of the first rod and then continously transversed endwise over all of the rods of the series and the spaces between the same, the ends of the rods, except for the first rod of the series, being journalled in and supported by arms, there being one pair of arms for each rod, means for pivotally supporting the arms whereby each pair of arms can be swung about a horizontal pivotal axis, means connected to said arms for simultaneously adjusting the angularity of each pair of arms relative to the vertical, the angular adjustment of the arms for the second and subsequent rods of the series relative to the vertical being progressively greater for the series and whereby the spaces between adjacent rods remain equal for the entire series, and means for receiving the pickles of desired size and configuration which are conveyed over all of the rods of the series, the spacing between adjacent rods also being such that undesired pickles, including those that are seriously crooked and those having one end portion substantially larger than the other end portion, drop through the spacing, and means for separately receiving the pickles that drop between the rods.

2. Apparatus for the sorting of elongated agricultural products which are generally round in section, a series of spaced parallel horizontal rods, the ends of the rods, except for the first rod of the series, being journalled in and supported by the upper ends of depending arms, there being one pair of arms for each rod, means for pivotally supporting the arms at fixed points intermediate the ends of the arms whereby each pair of arms can be swung about a corresponding pivotal axis, means for conveying said products in the direction of their length and for delivering the same upon the first of said series of rods, driving means for rotating the rods in the same direction whereby products are moved over the rods, rigid means pivotally connected to the lower ends of the arms, and a single manually operated means connected to rigid means for adjusting the angularity of each pair of arms relative to the vertical while maintaining a fixed spacing between the lower ends of the arms, the location of the pivot points for the pivotal axis of each pair of arms being so located relative to the ends of the arms that the angular adjustment of the arms for the second and subsequent rods of the series relative to the vertical is progressively greater and whereby the spaces between adjacent rods remain equal for the entire series.

* * * * *